United States Patent [19]

Wyman

[11] Patent Number: 4,679,630

[45] Date of Patent: Jul. 14, 1987

[54] METHOD OF COMPLETING PRODUCTION WELLS FOR THE RECOVERY OF GAS FROM COAL SEAMS

[75] Inventor: Richard E. Wyman, Calgary, Canada

[73] Assignee: Canadian Hunter Exploration Ltd., Calgary, Canada

[21] Appl. No.: 812,639

[22] Filed: Dec. 23, 1985

[51] Int. Cl.[4] ..... E21B 43/26

[52] U.S. Cl. ..... 166/305.1; 166/280

[58] Field of Search ..... 166/280, 305.1, 281

[56] References Cited

U.S. PATENT DOCUMENTS 4,401,162 8/1983 Osborne ..... 166/280 X 4,566,539 1/1986 Pulma ..... 166/280 X

*Primary Examiner*—Stephen J. Novosad

*Assistant Examiner*—Thomas J. Odar

*Attorney, Agent, or Firm*—Fleit, Jacobson, Cohn & Price

[57] ABSTRACT

A method of completing a production well for the recovery of gas from a coal seam is disclosed. The well is of the type having a casing cemented in the well and the method comprises the steps of providing perforations in the casing above and/or below the coal seam, and hydraulically fracturing the coal seam through the perforations in the casing.

4 Claims, 4 Drawing Figures

METHOD OF COMPLETING PRODUCTION WELLS FOR THE RECOVERY OF GAS FROM COAL SEAMS

BACKGROUND

This invention relates to the recovery of gas from coal seams, and more particularly to a new method of completing wells used for the demethanization of coal seams.

Many different methods for completing wells used for demethanization of coal seams have been employed including: open hole, open hole with abrasijet scoring, open hole with fracturing, slotted liner, cased hole with perforation only, and cased hole with fracture stimulation. Different fracturing techniques have also been used including gelled water, nitrogen foam with and without proppant, fresh water with and without proppant, and fresh water with friction reducing organic polymer with proppant.

The main problem with most coal bed completion techniques, is the migrating coal fines. This frequently leads to plugging or impairment behind perforated casings or slotted liners or in filling the rathole and covering the perforations, which leads to a severely decreased flow of gas.

OBJECT AND SUMMARY OF THE INVENTION

It is therefore the object of the present invention to provide a new method of well completion which would substantially prevent coal fines from blocking the perforations in the well casing.

The method, in accordance with the present invention, comprises the steps of providing perforations in the casing of the well above and/or below the coal seam, and hydraulically fracturing the coal seam through the perforations in the casing.

The perforations are preferably made at a distance up to 5 meters from the coal seam.

Once the hydraulic fracture is initiated with a suitable fluid, a fine grained proppant, such as sand or high strength ceramic grains, may be used to stimulate gas flow.

BRIEF DESCRIPTION OF THE DRAWINGS

The invention will now be disclosed, by way of example, with reference to the accompanying drawings in which.

DETAILED DESCRIPTION

Figure 1:
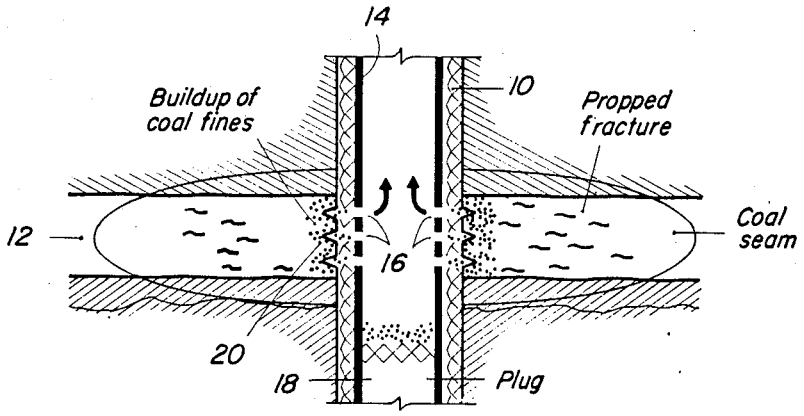
Fig. 1 (PRIOR ART)
FIGS. 1 and 2 illustrate a conventional method of completing a production well used for the recovery of gas from a coal seam.

Referring to FIG. 1, there is shown a portion of a well 10 drilled through earth formations adjacent a coal seam 12. A casing 14 is cemented in place in the well and provided with perforations 16 opposite the coal seam 12. The casing is blocked below the coal seam by a plug 18.

Figure 2:
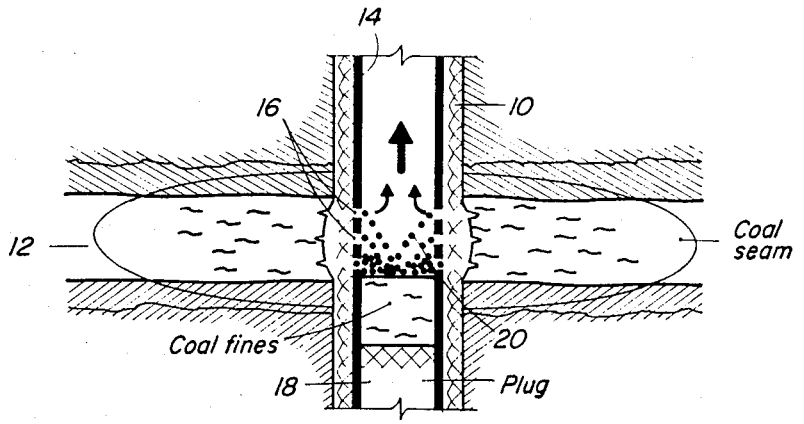
Fig. 2 (PRIOR ART)

Of the major problems that inhibit successful completions in coal seams, the most difficult to solve has been the prevention of impairment due to migration of coal fines 20 which accumulate near the perforations 16 during withdrawal of gas from the coal seam. Even in cased holes that have been hydraulically fractured through the perforations opposite the coal seam, the fines tend to plug the propped fracture near the perforations or the perforations themselves. Sometimes enough fines flow through the perforations to eventually plug the casing over and above the perforated interval as shown in FIG. 2 of the drawings. In any of the above cases, the result is severe restriction to the flow of gas.

Figure 3:
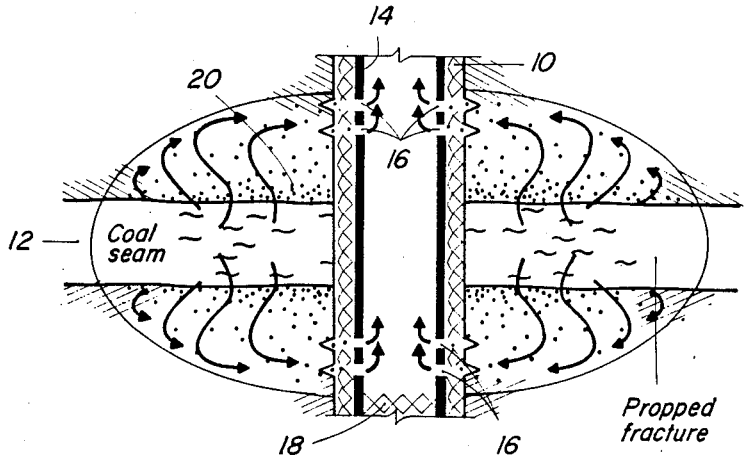
FIG. 3 illustrates a method of completing a production well in accordance with the present invention.

FIG. 3 of the drawings shows the method of the present invention to solve the above problem. This is accomplished by avoiding placing any perforations or slots through the casing opposite the coal seam. Instead, the perforations or slots are introduced above and/or below the coal seam. By removing the focal point for fines migrations away from the coal seam and introducing a broad area fine mesh "filter", the fines do not have an opportunity to impair the gas flow. The distance of the nearest perforation to the coal seam is not critical, but in a typical completion might be anywhere up to 5 meters. The number and gross interval of perforations may vary but a preferred configuration might be a helical pattern of six to twelve perforations per meter for two to five meters above and below the coal seam. Then the "filters" may be emplaced with a fluid that is pressured to exceed the fracture gradient of the formation opposite the perforations. After the formation fracture is initiated with the fluid, a fine grained proppant, such as sand or high strength ceramic grains is introduced as in conventional hydraulic fracturing as shown in FIG. 3. Pressure is then quickly released on the fracturing fluid to insure closure of the formation onto the proppant before the proppant has a chance to settle.

Figure 4:
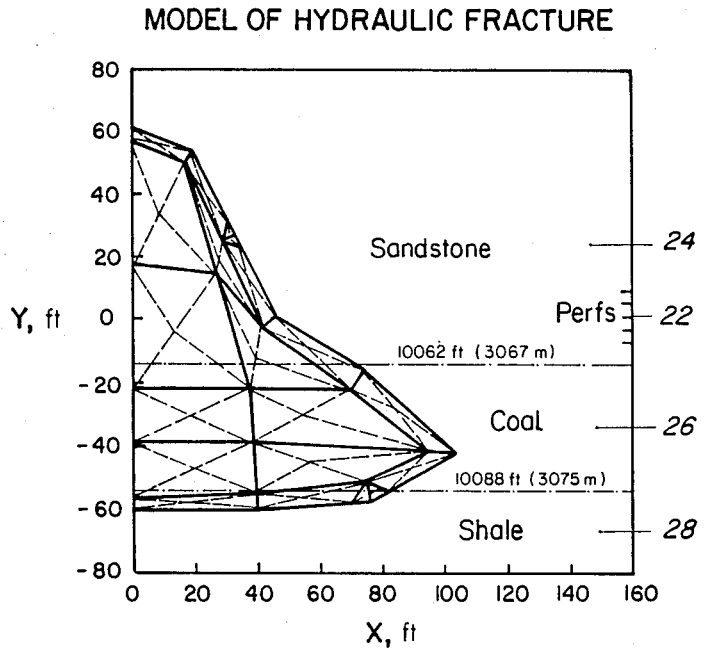
FIG. 4 illustrates a model of hydraulic fracturing initiated through perforations in the well casing above the level of the coal seam.

FIG. 4 of the drawings shows a model of hydraulic fracture initiated through perforations 22 located in a sandstone formation 24 above a coal seam 26 at about 10,000 feet below the earth surface. The fracture grows initially in the sandstone formation 24 and when the fracture intersects the coal seam, the subsequent growth is predominantly in the coal seam 26. As the fracture grows, the pressure will again rise to a level sufficient to propagate the fracture in both formations. However, the length of the fracture in the sandstone formation will be considerably less than for the coal seam. There is little propagation in the shale formation 28. The fracture thus preferentially propagates within the coal seam while allowing ample filtration area around the perforated interval.

With such a technique, coal fines may be screened out over a large area as shown in FIG. 3 rather than focused at perforations or flow channels opposite the coal seam as shown in FIGS. 1 and 2. With this new technique, even if one preferential flow path started to plug there would be an almost unlimited number of alternate paths within the "filter" through which the gas could flow.

Additional benefits for gas flow may follow if the beds surrounding the coal seam were gas charged tight sands. The technique in accordance with the present invention is especially suitable for multiple seams of coal within a gross interval. It would not matter whether the coal seams were thick or thin.

Although FIG. 4 shows a model of hydraulic fracture wherein perforations are located above the coal seam, similar results would be obtained if perforations were located above and below the coal seam. The only changes would be short length fractures in both the sandstone and shale formations 24 and 28 instead of just the sandstone formation 24.

I claim:

1. A method of completing production wells for the recovery of gas from a coal seam and having a casing cemented in the well, comprising the steps of:

(a) providing perforations in the casing opposite earth formations located above and/or below the coal seam; and (b) hydraulically fracturing the coal seam through the perforations in the casing, said fracturing of the coal seam propagating initially through the earth formations located above and/or below the coal seam and providing a filter for the coal fines to prevent their migration toward said perforations and plugging or impairment of the perforations during withdrawal of gas from the coal seam through the perforations.

2. A method as defined in claim 1 wherein the perforations are made at a distance up to 5 meters from the coal seam.

3. A method as defined in claim 1, wherein a fine grained proppant is used during hydraulic fracturing.

4. A method as defined in claim 3, wherein the proppant is sand or high strength ceramic grains.

* * * * *